United States Patent [19]

Lassiter

[11] 4,378,672

[45] Apr. 5, 1983

[54] RING/TRAVELER SYSTEM NOISE REDUCTION

[75] Inventor: B. Dean Lassiter, Greensboro, N.C.

[73] Assignee: Burlington Industries, Inc., Greensboro, N.C.

[21] Appl. No.: 211,048

[22] Filed: Nov. 28, 1980

[51] Int. Cl.[3] ..... D01H 7/54

[52] U.S. Cl. ..... 57/122

[58] Field of Search ..... 57/119, 122

[56] References Cited

U.S. PATENT DOCUMENTS

| | | | |
|---|---|---|---|
| 410,256 | 9/1889 | Shaw . | |
| 679,930 | 8/1901 | Webster . | |
| 2,452,323 | 10/1948 | Platzer | 57/120 |
| 2,454,707 | 11/1948 | Meyers et al. | 57/122 |
| 2,796,727 | 6/1957 | Katerman | 57/119 |
| 3,056,251 | 10/1962 | Keight | 57/122 |
| 3,093,957 | 6/1963 | Tetreault | 57/122 |
| 3,100,374 | 8/1963 | Backus | 57/122 |
| 3,482,385 | 12/1969 | Pitts . | |
| 3,494,120 | 2/1970 | Chilpan et al. | 57/122 X |
| 3,568,427 | 3/1971 | Wurmli | 57/122 |
| 3,974,633 | 8/1976 | Clevenger | 57/1 R |
| 3,974,634 | 8/1976 | McCall | 57/122 X |
| 3,975,894 | 8/1976 | Suzuki | 57/1 R X |
| 4,031,690 | 6/1977 | Thomas et al. | 57/1 R |

FOREIGN PATENT DOCUMENTS 1274858 2/1962 Fed. Rep. of Germany .

OTHER PUBLICATIONS

U.S.M. Corporation, Molly Division, Well-Nut Fasteners, 1977, Advertising Circular supplied by Applicant.

*Primary Examiner*—Donald Watkins

*Attorney, Agent, or Firm*—Cushman, Darby & Cushman

[57] ABSTRACT

A spinning or twisting ring assembly and method of utilization thereof provide for unexpectedly reduced noise. The ring assembly includes a metal ring for mounting a traveler, a rigid holder support, and an annular ring holder of resilient material operatively connecting the ring and support. The support has two openings formed therein radially outward of the ring, and spaced about 180° apart. Each opening receives a fastener, the fastener extending through the opening and connecting the support to a ring rail. Between the support and the ring rail is a bushing of resilient material which isolates the support from the ring rail so that no portion of the support touches the ring rail and no metal portion of the fastener touches the ring rail. The assembly allows slight movement of the ring with the traveler.

14 Claims, 6 Drawing Figures

RING/TRAVELER SYSTEM NOISE REDUCTION

BACKGROUND AND SUMMARY OF THE INVENTION

The invention relates to an assembly and method of utilization thereof for the minimization of noise and vibration in a spinning or twisting ring assembly for textile yarns. There have been numerous prior attempts to minimize spinning ring noise and vibration, some of which have used rings made of plastic or elastomeric material (see U.S. Pat. No. 2,796,727 and French Pat. No. 1,274,858 for typical embodiments), and others of which provide an elastomeric ring holder for mounting a metal ring to a ring rail around the entire ring periphery (see U.S. Pat. Nos. 410,256, 2,454,707 and 3,974,634 as examples). While such structures do eliminate a significant amount of noise and vibration, even with such arrangements some spinning and twisting ring assemblies continue to be noisy structures, and it is generally not feasible to bring them within OSHA noise limits.

The present invention is primarily directed toward reduction of noise in spinning ring horizontal traveler systems, but it is believed broadly applicable to twisting ring and vertical traveler systems as well. It is more specifically concerned with the further reduction of noise in those noise-reducing ring systems of the type where a resilient preferably elastomeric ring holder is employed to mount a metal ring, carrying a metal traveler.

Today's noise-reducing elastomeric or resilient ring holders come in differing forms, depending on the individual manufacturer. In several forms, besides the elastomeric ring holder itself, there is commonly present some kind of rigid holder support member, the latter typically mounted beneath and/or around the elastomeric member. The support member, which usually serves both as a support and as a means for attachment of the ring holder to the ring rail, is commonly made of metal or high-modulus plastic. In one typical embodiment it comprises a flat metal plate beneath and firmly cemented or molded to the ring holder, but it may take other forms as well, two of which are shown in U.S. Pat. No. 3,974,634. The support member typically includes two or more lugs, each bearing a hole or slot for rigidly bolting or screwing the combined ring assembly to the ring rail.

According to the present invention, the significance of noise associated with spinning and twisting ring assemblies has been taken into account to provide a further, surprising, improvement in a noise-reducing system. Thus, according to the present invention, it has unexpectedly been found that when mechanical compliance is provided between the ring holder support and the ring rail, noise from the system is further dramatically reduced. It has also been found that when the ring holder support is mounted to the ring at only two points spaced about 180° from each other utilizing elastomeric bushings, the ring is observed to be moving slightly when the traveler is in motion, thereby helping to reduce noise apparently emanating from ring/traveler interaction. Utilizing the teachings of the present invention, it is possible to bring spinning and twisting ring assemblies within OSHA noise standards in some cases where prior art structures had not proved sufficient.

According to one aspect of the present invention, a spinning or twisting ring assembly for mounting a metal traveler and adapted to be mounted to a ring rail is provided. The assembly includes, in downward succession, a metal ring for mounting the traveler, an annular ring holder of resilient preferably elastomeric material, and a rigid holder support having a plurality of openings formed therein for receipt of fasteners for attaching the support and therewith the entire assembly to a ring rail. Additionally, a plurality of fasteners are provided for receipt by the openings in the support, and in particular, bushing means of elastomeric material for cooperation with the fasteners to attach the support to a ring rail, thereby isolating the support from the ring rail so that no portion of the support touches the ring rail, and no metal portion of the fasteners touches the ring rail. The support openings preferably consist of two utilized openings spaced about 180° from each other in lugs around the periphery of the support, with a fastener associated with each of the two utilized openings. The bushing means can comprise a grommet of elastomeric material or an elastomeric tube having a flange formed at one end thereof for engaging a fastener head, and having a metal nut captive within and by the interior surface of the tube at the other end thereof for engaging a fastener shank.

According to another aspect of the present invention, a spinning or twisting ring assembly is provided including a metal ring for supporting the traveler, an annular ring holder of resilient, preferably elastomeric material, a rigid holder support having first and second openings spaced about 180° apart, and first and second fasteners for fastening the support at, and only at, the corresponding first and second openings provided for attachment of the assembly to a ring rail. The assembly further includes first and second bushing means of elastomeric material for disposition between the holder support and the ring rail for mounting the ring assembly at only the first and second support fastener-receiving openings so that the ring is allowed to move slightly with the traveler. The assembly is provided in combination with a ring rail having first and second bores at each spinning or twisting position for receipt of the fasteners. The bores extend between the first and second parallel spaced faces of the ring rail, and each of the bushing means lines a ring rail bore with which it is associated, in addition to being disposed between the support and the ring rail and engaging each of the parallel surfaces of the ring rail.

According to another aspect of the present invention, a method of mounting a spinning ring assembly to a ring rail is provided. The method is practiced by placing the bushings in operative association with the bores in the ring rail, each bushing lining the bore in which it is disposed and engaging the ring rail parallel surfaces; inserting the fastener shank through each opening in the support and mounting the support so that the shank extends through a bushing to the opposite side of the ring rail with the head of the fastener operatively engaging the support, and with a portion of the bushing disposed between the support and the ring rail; and effecting relative movement between each fastener shank and the fastener shank-holding component associated therewith so that the support is held tightly to the ring rail with a portion of each bushing being held between the ring rail and a shank-holding component.

It is the primary object of the present invention to provide a spinning or twisting ring assembly and a method of utilization thereof which minimize noise and vibration. This and other objects of the invention will become clear from an inspection of the detailed description of the invention and from the appended claims.

DETAILED DESCRIPTION OF THE DRAWINGS

Figure 1:
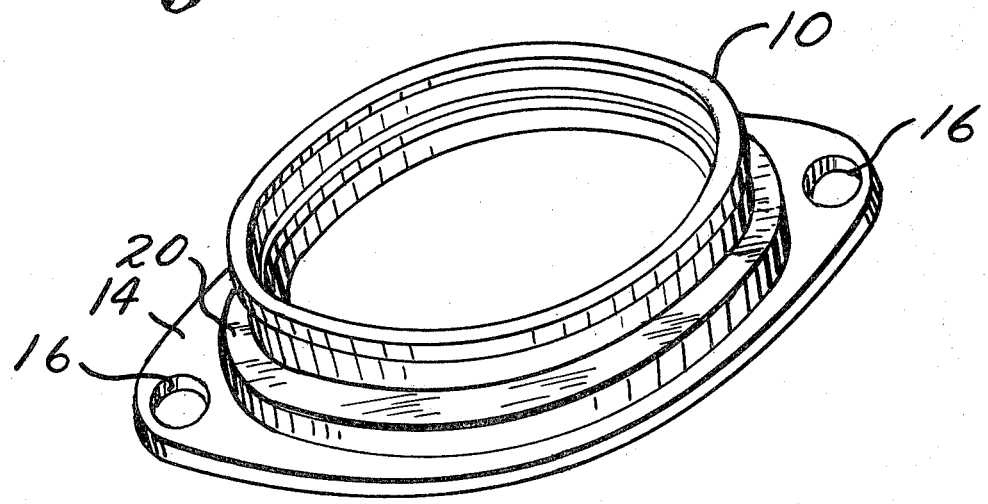
FIG. 1 is a perspective view of an exemplary commercially available ring assembly which is utilizable in practicing the present invention.
Figure 2:
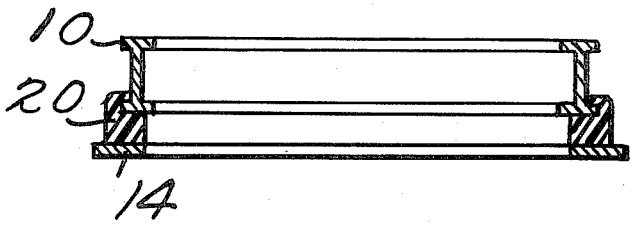
FIG. 2 is a longitudinal cross-sectional view of the ring assembly of FIG. 1.

A commercially available spinning ring assembly which may be utilized in practicing the present invention is illustrated in FIGS. 1 and 2. A comparable twister ring assembly could equally well be described herein, and employed with the invention. This spinning assembly is manufactured and sold by Lord Kinemetics, Model No. J-16550-1. The assembly includes a metal ring 10 for mounting a traveler thereon (see traveler 12 in FIG. 4), an annular holder 20 of elastomeric material, and a holder-supporting plate 14 of metal, the plate having a plurality of openings 16 formed therein for receipt of fasteners attaching the plate 14 to a ring rail (see ring rail 18 in FIG. 4). The holder 20, preferably formed of an elastomer such as butyl, neoprene, or nitrile rubber, is bonded to plate 14, as with heat or an adhesive. Its principal purpose is to anchor the ring in resilient fashion such that it provides a significant amount of reduction in ring/traveler and ring/rail noise, compared to the more conventional metal ring holders of the art. In normal usage of the assembly illustrated in FIGS. 1 and 2, a pair of screws are passed through openings 16 and through corresponding bores (e.g., see bores 22 in FIG. 4) in a ring rail (e.g., ring rail 18 in FIG. 4) so that the plate 14 is in direct contact with the metal ring rail.

This particular art device is typical of others of its general type having a metal ring, a relatively large resilient preferably elastomeric ring holder having a high degree of noise and vibration reducing capability, and a stiff support member which serves to fix the ring holder in place and to provide a means for rigid attachment of the assembly to a ring rail spinning or twisting position.

In view of the mechanical compliance provided between the ring 10 and ring rail 18, it has been assumed in the trade that the maximum noise reduction possible is being attained utilizing the Lord assembly. However, according to the present invention it has been unexpectedly found that when the supporting plate 14 is mounted in a particular manner to the ring rail, even further pronounced noise and vibration reductions can be achieved.

Figure 3:
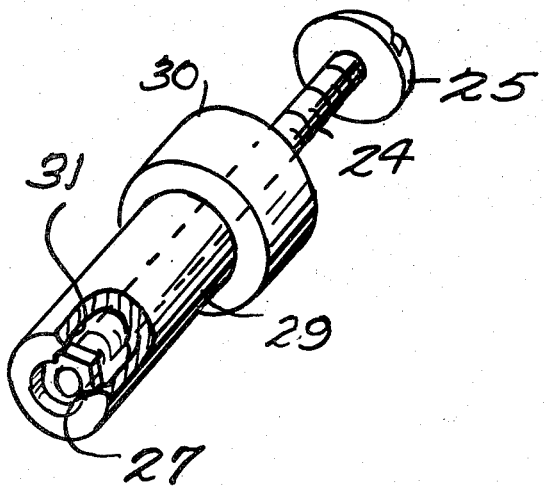
FIG. 3 is a perspective view, with portions cut away for clarity of illustration, of exemplary conventional fastener and bushing means that may be utilized in the practice of the present invention.

In FIG. 3 an exemplary bushing and fastener assembly is illustrated that is utilized with the ring assembly of FIGS. 1 and 2 for the practice of the invention. The fastener preferably includes a threaded shank 24 and a head 25, which head 25 may have a screw slot 26 (see FIG. 4) formed therein. The shank 24 holding component of the fastener includes the metal nut 27 which is screw-threaded to receive the shank 24. The bushing means illustrated in FIG. 3 includes the tube 29 of elastomeric material (e.g., neoprene) having a flange 30 formed at one end thereof, and captivating the nut 27 by and within the interior surface 31 of the tube 29 adjacent the end thereof opposite the flange 30. The entire assembly illustrated in FIG. 3 is sold by the Molly Division of USM Corporation of Temple, Pa., under the trademark "WELL-NUT".

Figure 4:
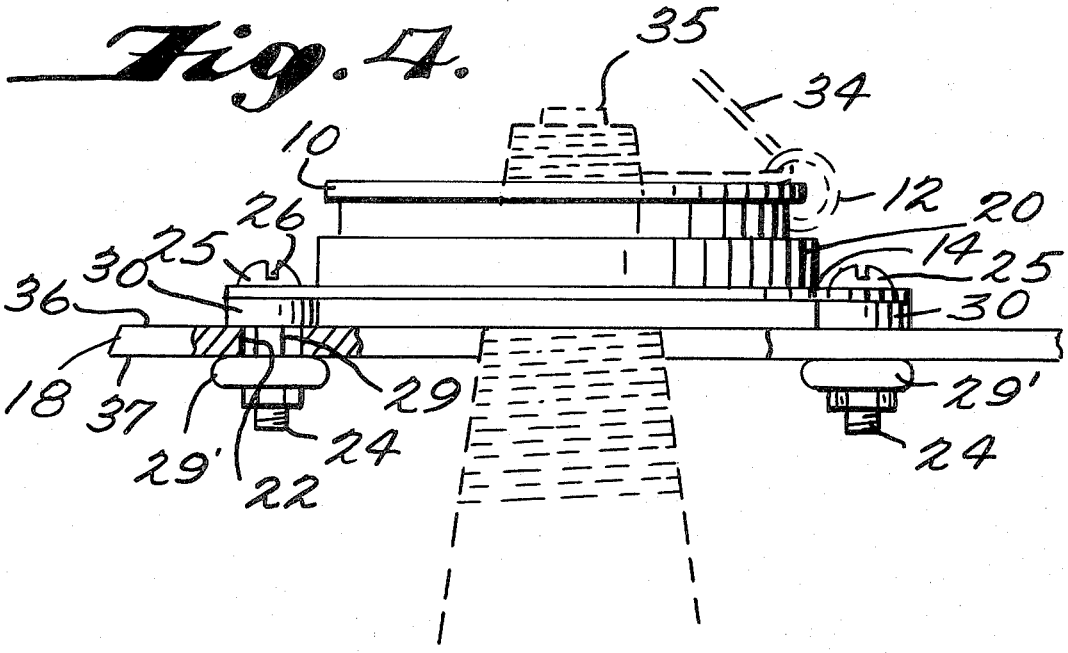
FIG. 4 is a side view, partly in elevation and partly in cross-section, of a complete exemplary spinning ring assembly according to the present invention.

FIG. 4 illustrates an exemplary complete spinning ring assembly according to the present invention. The assembly is illustrated in FIG. 4 in association with yarn 34 passing through traveler 12 and being taken up on rotating bobbin 35 on the spindle (not shown), the yarn and bobbin being illustrated in dotted line.

As illustrated in FIG. 4, according to the present invention the bushing means 29, etc., are provided for cooperation with each of the openings 16 in plate 14 and corresponding bores 22 in ring rail 18, to facilitate attachment of the plate 14 to the ring rail 18. The flange 30 of each bushing means is disposed between the plate 14 and the top surface 36 of ring rail 18, while the tube 29 lines the bore 22. When the fastener shank 24 is inserted through an opening 16 and through the passageway 31 in the tube 29 into engagement with the nut 27, and the head 25 is rotated to effect relative linear movement of the nut 27 toward the head 25, a portion of the tube 29 [the portion being indicated by reference numeral 29' in FIG. 4] bulges outwardly and engages bottom surface 37 of ring rail 18, the surfaces 36, 37 being substantially parallel to each other with the bores 22 interconnecting them. Thus, the bushings provide isolation of the plate 14 from the rail 18 so that no portion of the plate 14 touches the rail 18, and no metal portion of the fasteners (e.g., nut 27 or head 25) touches the rail 18.

Preferably, according to the present invention only two fasteners and associated bushings are provided for mounting the plate 14. While the plate 14 may have any number of openings formed therein, preferably only two openings 16 are utilized to effect mounting, the two openings 16 utilized being spaced about 180° from each other. By providing mounting in such a manner, it can be determined by observation utilizing a strobe light that the ring 10 moves slightly with the traveler 12, thereby reducing interaction forces between the two. Such a mounting also minimizes rail radiated noise, due to the additional isolation of the plate 14 from the rail 18 by the elastomeric flange 30, etc., and/or due to noise and vibration source modification (as a result of slight ring 10 movement with traveler 12). Although a spacing of 180° between the utilized openings 16 has proven effective, any comparable relative spacing that achieves the desired results is appropriate.

Figure 5:
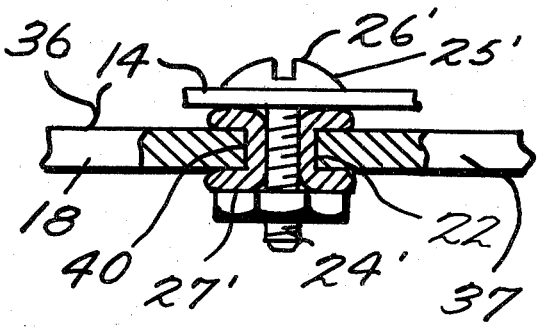
FIG. 5 is a detail side view, partly in cross-section and partly in elevation, illustrating an alternative bushing means utilizable in the complete spinning ring assembly according to the invention.

A modification of a bushing and fastener for facilitating attachment of the plate 14 to the rail 18 is illustrated in FIG. 5. In this embodiment, a grommet 40 is provided. The grommet 40 lines the bore 22, and receives the shank 24' of the fastener therein. Additionally, a portion of the grommet engages the top surface 36 of rail 18, while another portion engages the bottom surface 37. The portion of the grommet 40 engaging top surface 36 is disposed between plate 14 and ring rail surface 36, while the portion of the grommet engaging bottom surface 37 is disposed between the fastener 27' and the bottom surface 37.

According to the present invention, a method of mounting a spinning ring assembly to a ring rail is provided that minimizes the total noise output associated with the ring/traveler assembly, thus effecting the meeting of OSHA noise standards. According to a preferred exemplary method according to the present invention, the ring assembly illustrated in FIG. 1 is mounted to a ring rail 18 by inserting tube 29 through bore 22, with flange 30 engaging surface 36 of ring rail 18 (this being provided for each of the bores 22); bringing plate 14 into contact with flanges 30 so that the slotted openings 16 in plate 14 are in alignment with the interior passageway 31 in tube 29; passing a fastener shank 24 through each opening 16 into engagement with a nut 27; and, inserting a screwdriver blade in slot 26 and effecting relative rotational movement between head 25 and nut 27 utilizing the screwdriver until the tube 29 bulges (at 29') and the plate 14 is held securely in place by the engagement of rail surfaces 36, 37 by flanges 30 and tube bulges 29'.

Figure 6:
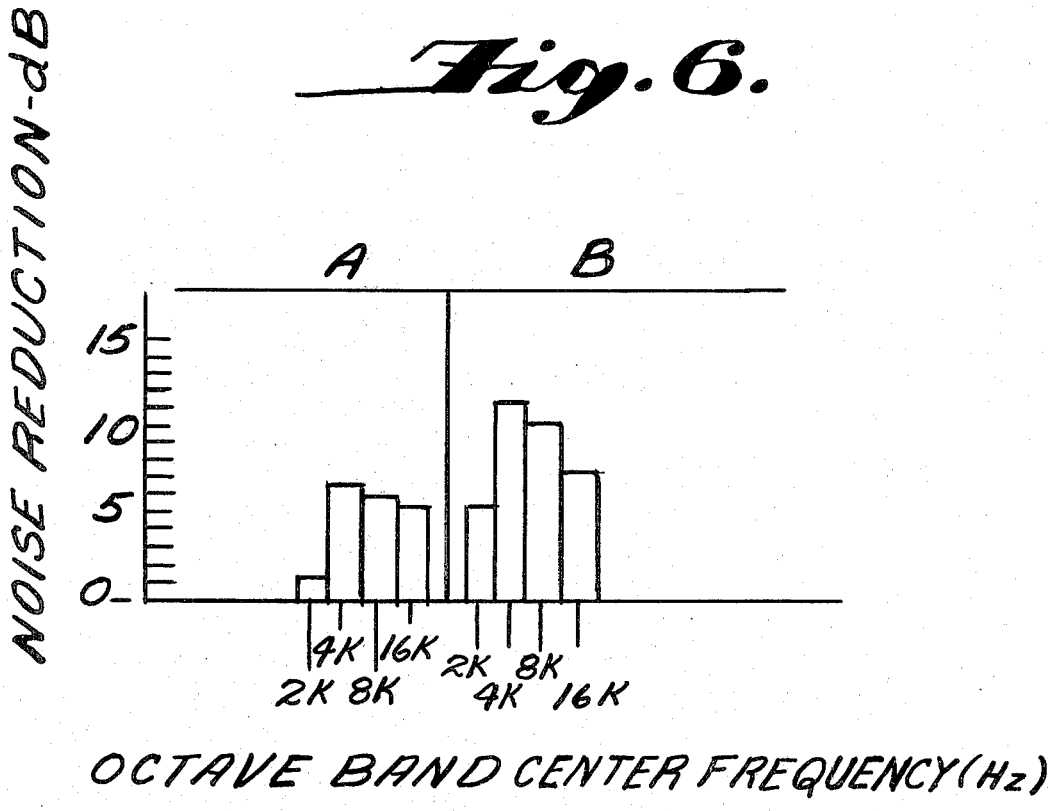
FIG. 6 is a graphical representation comparing noise reduction achieved according to the invention as compared to commercially available prior noise-reducing structures, the reductions representing the improvements over a conventional ring holder made of aluminum.

The unexpected advantageous noise reduction achievable according to the present invention, relative to a conventional metal-mounted ring, is diagrammed schematically in FIG. 6, and compared to noise reductions achieved utilizing noise-reducing spinning ring assemblies of the art. The results in FIG. 6 were obtained at 7,000 rpm spindle speed with a Dary number 17 traveler. Sound levels were measured by a ½-inch B & K 4134 microphone, 1.5 m off the floor and 0.5 m away from the machine, centered in front of six positions under test. The noise generated by the spindles (Roberts) was well below that generated by the ring/traveler system. Octave band levels for sound were determined on a Nicolet Frequency Analyzer. The performance of the different mountings was determined by the amount of noise reduction over a conventional aluminum mounting in the 2 kHz, 4 kHz, 8 kHz, and 16 kHz octave bands. The results A in FIG. 6 were obtained utilizing the Lord Kinemetics ring assembly illustrated in FIGS. 1 and 2 of the drawings, and connected to the ring rail 18 so that the ring-supporting plate 14 was directly in contact with the ring rail 18. The results B in FIG. 6 were obtained utilizing the structure of the invention illustrated in FIG. 4 of the drawings. The noise reduction readings were obtained utilizing a conventional aluminum ring holder as the standard against which reduction was measured.

The significance of noise reductions in decibels can best be comprehended by thinking in terms of the acoustic energy reduction, which is related to the physical variable of mean squared pressure, in preference to thinking in terms of the logarithmic decibel scale. For example, in FIG. 6 one may logically center attention on the 8 kHz octave band, known to be the dominant frequency range for ring/traveler noise. The invention results, B, in the 8 kHz band indicate an improvement of 5 decibels over the results with the Lord Kinemetrics ring assembly A. Assuming the sound radiated by the source to be omnidirectional, this 5-decibel reduction is equivalent to an improvement in the acoustic energy of 68 percent in the dominant frequency band. Expressed otherwise, over two-thirds of the noise remaining after substituting the Lord Kinemetics noise-reducing ring holder system for a conventional aluminum holder system has been further eliminated by application of the invention to the Lord Kinemetics system.

It is also to be seen from FIG. 6 that, compared to the baseline noise from a similar grouping of conventional aluminum ring holders tested under the same conditions as above, the noise reduction effected by the system of the invention is of the order of 10 decibels. This is equivalent to 90 percent reduction in acoustic energy, or to the noise in the ring/traveler system of the invention being only one-tenth of that observed with conventional aluminum-mounted ring/traveler systems, when both are compared under the conditions of the test.

Another way of viewing the results of the tests is that, were it experimentally possible to position ten ring/traveler systems of the invention in the space occupied by one ring/traveler system with conventional aluminum-mounted rings, the noise from the two combinations would be essentially equal.

Similar improvements in noise-reducing performance have been demonstrated in comparative tests with other noise-reducing traveler/ring structures, such as the Platt Saco Lowell all-rubber ring holder of aforementioned U.S. Pat. No. 3,974,634.

Similar tests conducted at 6,000 and 8,000 rpm spindle speed produced comparable results, in each case the assembly according to the invention performing better at each octave band than the prior art dampening structures (or the aluminum ring holder standard). The unexpected magnitude of the noise reductions effected by the very simple structural modifications of the invention is most surprising and totally unpredictable.

It will be seen that according to the present invention an improved spinning ring assembly and method of utilization thereof have been provided. While the invention has been herein shown and described in what is presently conceived to be the most practical and preferred embodiments thereof, it will be apparent to those of ordinary skill in the art that many modifications may be made thereof within the scope of the invention, which scope is to be accorded the broadest interpretation of the appended claims so as to encompass all equivalent structures and methods.

What is claimed is:

1. A spinning or twisting ring assembly for mounting a traveler, and adapted to be mounted to a ring rail, said assembly comprising a metal ring for mounting a traveler thereon;

a rigid holder support having a plurality of openings formed therein for receipt of fasteners for attaching it to a ring rail;

an annular ring holder of resilient material operatively connected between said metal ring and said rigid holder support;

a plurality of fasteners for receipt by said openings in said rigid holder support; and bushing means of resilient material for cooperation with said fasteners to attach said rigid holder support to a ring rail while isolating said support from the ring rail, so that no portion of said support touches the ring rail and no metal portion of said fasteners touches the ring rail.

2. An assembly as recited in claim 1 wherein said plurality of openings formed in said support consist only of two utilized openings, said openings being spaced form each other about 180° around the periphery of said support; and wherein said plurality of fasteners comprises two fasteners.

3. An assembly as recited in claims 1 or 2 wherein the ring rail with which the assembly is adapted to cooperate has a pair of parallel flat surfaces with a plurality of bores formed in the surfaces corresponding to the number of and aligned with said fasteners for attaching said support to the ring rail; and wherein said bushing means comprise grommets of elastomeric material, each grommet lining a bore in the ring rail and having a portion engaging each of the parallel surfaces of the ring rail.

4. An assembly as recited in claims 1 or 2 wherein the ring rail with which the assembly is adapted to cooperate has a pair of parallel flat surfaces with a plurality of bores formed in the surfaces corresponding to the number of and aligned with said fasteners for attaching said support to the ring rail; and wherein said bushing means and said fasteners comprise, for each opening in said support, a metal screw in screw-threaded relationship with a metal nut, the metal nut captive within and by the interior surface of a tube of elastomeric material, said elastomeric tube having a flange at one end thereof adjacent the bottom of the head of the metal screw, and disposed between the supporting plate and surface of the ring rail.

5. A method of mounting a metal ring, adapted to mount a traveler, in an opening formed in a metal ring rail, the ring rail having a plurality of bores formed therein extending between two parallel flat surfaces thereof; utilizing a first structure comprising the metal ring, a support having a plurality of fastener-receiving openings formed therein, and an annular ring holder of resilient material connecting the ring and support; and also utilizing a plurality of fasteners, each fastener including a shank, head, and shank-holding component, and, a bushing of resilient material for each fastener, said method comprising the steps of:

placing the bushings in operative association with the bores in the ring rail, each bushing lining the bore in which it is disposed and engaging the rail surfaces;

inserting a fastener shank through each opening in the support, and mounting the support, so that the shank extends through a bushing to the opposite side of the ring rail with the head of the fastener operatively engaging the support, and with a portion of the bushing disposed between the support and ring rail; and effecting relative movement between each fastener shank and the fastener shank-holding component associated therewith so that the support is held tightly to the ring rail with a portion of each bushing between the ring rail and shank-holding component.

6. A method as recited in claim 5 wherein only two bushings and two fasteners are utilized, and wherein said inserting step is accomplished by placing the fasteners through two openings in the support spaced about 180° from each other around the support.

7. A spinning or twisting ring assembly including:

a ring for supporting a traveler;

a rigid holder support having means defining first and second openings therein, both openings spaced radially outwardly from said ring, and being spaced about 180° apart;

first and second fasteners for fastening said support at, and only at, said first and second openings to a ring rail, the fasteners extending through corresponding openings in the ring rail; and first and second bushing means of resilient material for disposition between said support and a ring rail for mounting said support and ring at only said first and second fastener-receiving openings, so that the ring is allowed to move slightly with the traveler.

8. An assembly as recited in claim 7 wherein said bushing means are of elastomeric material.

9. An assembly as recited in claim 7 in combination with a ring rail having first and second bores therein for receipt of said first and second fasteners, said bores extending between first and second parallel spaced faces of said ring rail.

10. An assembly as recited in claim 9 wherein each of said first and second bushing means lines a ring rail bore with which it is associated, in addition to being disposed between said support and said ring rail, and engaging each of said parallel surfaces of said ring rail.

11. An assembly as recited in claim 10 wherein each of said bushing means comprises a grommet of elastomeric material.

12. An assembly as recited in claim 10 wherein each of said bushing means comprises a tube of elastomeric material having a flange formed at one end thereof for abutting a fastener head, and having a metal nut captive within and by the interior surface of the tube adjacent the end thereof opposite said flange, said nut for engaging a fastener shank.

13. An assembly as recited in claim 10 wherein both said ring and said support are of metal.

14. An assembly as recited in claim 13 further comprising an annular holder of resilient material operatively connected between said ring and support.

* * * * *